United States Patent [19]

Jauch

[11] 4,073,130

[45] Feb. 14, 1978

[54] CHIME CLOCK WITH MINUTE HAND SHAFT ROTATABLE IN BOTH DIRECTIONS

[75] Inventor: Christian M. J. Jauch, Louisville, Miss.

[73] Assignee: Spartus Corporation, Chicago, Ill.

[21] Appl. No.: 693,915

[22] Filed: June 8, 1976

Related U.S. Application Data

[63] Continuation-in-part of Ser. No. 671,143, March 29, 1976, Pat. No. 4,036,004.

[51] Int. Cl.[2] ..... G04B 21/02; G04C 21/04

[52] U.S. Cl. ..... 58/9

[58] Field of Search ..... 58/7–11

[56] References Cited

U.S. PATENT DOCUMENTS

| | | | |
|---|---|---|---|
| 641,476 | 1/1900 | Torres | 58/11 |
| 1,205,042 | 11/1916 | Smith | 58/8 |
| 3,702,529 | 11/1972 | Zeter | 58/9 |

*Primary Examiner*—E. S. Jackmon

*Attorney, Agent, or Firm*—Merriam, Marshall & Bicknell

[57] ABSTRACT

A chime clock has a cam mounted to rotate with the clock's minute hand shaft. A cam-follower mechanism actuates striking mechanism in response to clockwise rotation of the minute hand shaft and cam. Structure is provided to prevent the cam-follower from obstructing rotation of the cam and minute hand shaft in a counter-clockwise sense, as when setting the clock's minute hand by turning it backwards.

9 Claims, 8 Drawing Figures

CHIME CLOCK WITH MINUTE HAND SHAFT ROTATABLE IN BOTH DIRECTIONS

RELATED CASE

This is a continuation-in-part of Application Ser. No. 671,143, filed Mar. 29, 1976, now U.S. Pat. No. 4,036,004 and entitled "Clock with Striking Mechanism", and the disclosure thereof is incorporated herein by reference.

BACKGROUND OF THE INVENTION

The present invention relates generally to clocks with striking mechanisms for striking a chime, gong, or the like on the hour, half-hour, or quarterly fractions of the hour, such a clock being hereinafter called a chime clock. More particularly, the present invention relates to a chime clock in which the minute hand shaft is rotatable in both clockwise and counterclockwise senses.

Typically, a chime clock comprises a cam mounted directly on the clock's minute hand shaft to rotate with the minute hand shaft. The cam comprises a step or plurality of steps, corresponding to the hour, half-hour or quarterly fractions of the hour. A cam follower, connected to a striking mechanism, is positioned to ride along the peripheral edge of the cam, and, at the precise moment when a chime or other sound is required, the cam follower drops off a step on the cam, thereby actuating the striking mechanism to strike a chime, gong or the like. Structure for accomplishing the striking or chiming function is disclosed in more detail in said parent application Ser. No. 671,143, the disclosure of which has been incorporated herein by reference.

The minute hand shaft, together with the chime-controlling cam mounted thereon, conventionally rotates in a clockwise sense. It is sometimes desirable for the minute hand shaft to be capable of rotating in a counterclockwise sense. For example, when setting the minute hand of a chime clock, a person may try to turn the minute hand backwards, and this would urge the minute hand shaft in a counterclockwise sense. If the minute hand shaft was connected to other parts of the clock in such a manner that it could not be readily rotated in a counterclockwise sense, a person could damage the clock by trying to force the minute hand backwards.

In chime clocks having a striking mechanism of the type described in said parent application Ser. No. 671,143, the cam follower and related structure interfere with rotation of the minute hand shaft in a counterclockwise sense. More specifically, as the chime-controlling cam is rotated in a counterclockwise sense, the cam follower comes into engagement with the edge of a step on the cam, obstructing further rotation in a counterclockwise sense of the cam and minute hand shaft. As previously described, this could lead to damage to the clock mechanism when an unsuspecting person attempts to set the clock by turning the minute hand backwards.

SUMMARY OF THE INVENTION

In accordance with the present invention, structure is provided for permitting rotation of the minute hand shaft and the chime-controlling cam in a counterclockwise sense without damaging any part of the clock or striking mechanism. The cam follower and associated structure are arranged in such a manner, that, when the step on the chime-controlling cam engages the cam follower, during counterclockwise rotation of the cam, the cam follower is urged from its operative cam-engaging position to a displaced position out of the path of the cam step's edge, thereby removing any obstruction to further rotation of the cam in a counterclockwise sense. Subsequently, when normal clockwise rotation of the cam is resumed, the cam follower is urged to return to its operative position where it will follow the peripheral edge of the cam and drop off the cam step at the hour or appropriate fraction thereof.

Other features and advantages are inherent in the structure claimed and disclosed or will become apparent to those skilled in the art from the following detailed description in conjunction with the accompanying diagrammatic drawing.

DETAILED DESCRIPTION

Figure 1:
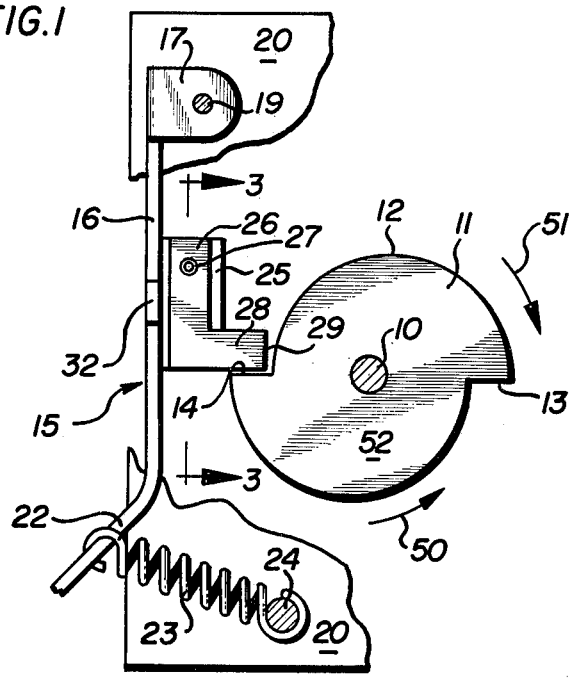
FIG. 1 is a rear view of part of a chime clock showing a chime-controlling cam and cam follower mechanism constructed in accordance with an embodiment of the present invention.
Figure 2:
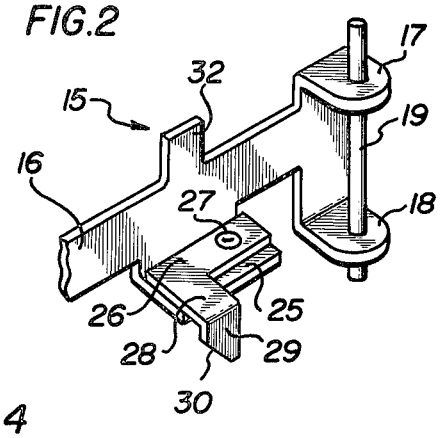
FIG. 2 is a fragmentary perspective of a portion of the cam followei mechanism of FIG. 1.
Figure 5:
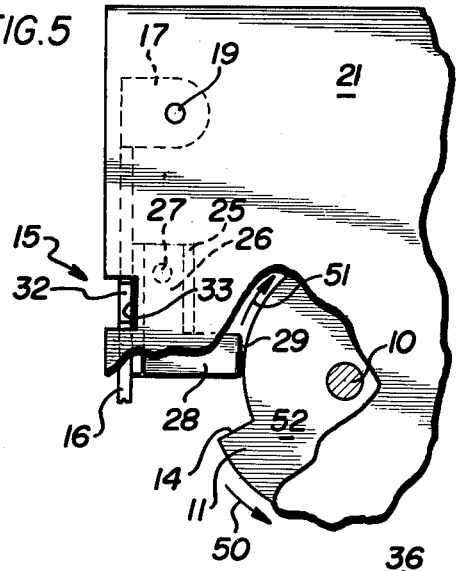
FIG. 5 is a fragmentary rear view of a portion of the mechanism illustrated in FIG. 1.

Referring initially to FIGS. 1, 2 and 5, there is illustrated a minute hand shaft 10 extending between front and back clock base plates 20, 21 (FIGS. 1 and 5). Fixed on shaft 10 is a chime-controlling cam 11 having a peripheral edge 12 and a pair of diametrically opposed cam steps 13, 14. Minute hand shaft 10 is rotatable in both clockwise and counterclockwise senses. The mechanism for driving the minute hand shaft, as well as the relationship of the minute hand shaft to the rest of the clock mechanism, is disclosed in said parent application Ser. No. 671,143.

When the minute hand shaft is rotating clockwise, during normal clock operation, shaft 10 rotates in the direction of arrow 50. When the minute hand shaft is rotated counterclockwise, e.g., as when turning the minute hand backwards, shaft 10 rotates in the direction of arrow 51.

Cam 11 is mounted for rotation in both clockwise and counterclockwise senses with minute hand shaft 10. Located adjacent cam 11 is a cam follower mechanism indicated generally at 15 and comprising a lever 16 having a pair of transversely extending, parallel, spaced apart tabs 17, 18 located at one end of lever 16. Extending through tabs 17, 18 is a pivot shaft 19 having opposite ends mounted on front and back base plates 20, 21. Lever 16 is mounted on shaft 19 for pivotal movement, toward and away from cam 11 and shaft 10. Lever 16 includes an angular portion 22 connected to one end of a spring 23 having another end connected to a post 24 extending between front and back base plates 20, 21. Spring 23 comprises biasing means normally urging lever 16 to pivot toward cam 11 and shaft 10.

Figure 4:
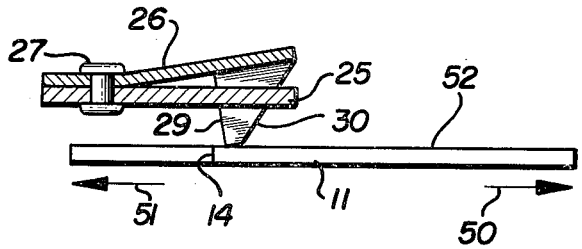
FIG. 4 is a sectional view similar to FIG. 3 showing the cam follower in a displaced position.
Figure 3:
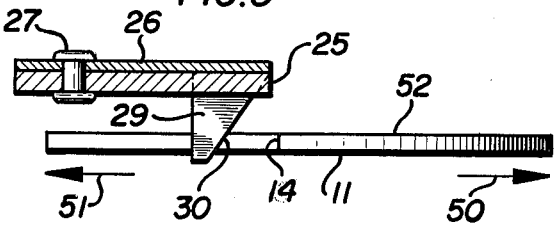
FIG. 3 is a sectional view taken along line 3—3 in FIG. 1 showing the cam follower in its operative position.

Extending from lever 16 toward cam 11 is a flange 25 and mounted on flange 25 is a flexible, leaf spring member 26 having one end fixed to flange 25 by a rivet 27. At the other end of flexible member 26, remote from rivet 27, is a transverse portion 28, extending toward cam 11, and depending from transverse portion 28 is a finger 29 having an angular edge 30 (FIGS. 2–4).

In normal clock operation, minute hand shaft 10 and cam 11 rotate in a clockwise sense (arrow 50), and a surface on finger 29 adjacent cam 11 engages the periphery 12 of cam 11. As finger 29 follows the periphery of cam 11 toward the next cam step, the finger and lever 16 are pivoted, about the axis of shaft 19, away from minute hand shaft 10 against the urging of spring 23. This cocks the lever for striking a chime, gong, or the like, or for actuating a striking mechanism; and this is described in more detail in said parent application Ser. No. 671,143.

In the illustrated embodiment, cam 11 includes two steps, 13, 14, spaced diametrically apart and so located as to correspond to the hour and half-hour positions of the minute hand shaft. When the clock's minute hand reaches the hour position, step 14 on cam 11 is at finger 29 which abruptly drops off periphery 12 of cam 11, at step 14, causing lever 16 to pivot sharply toward cam 11 and shaft 10, under the urging of spring 23. This causes the striking of a chime, gong, or the like, or the actuation of structure for striking a chime, gong, or the like, an operation described in more detail in said parent application Ser. No. 671,143.

As minute hand shaft 10 and cam 11 thereafter continue to rotate in a clockwise sense (arrow 50), finger 29 follows that part of peripheral cam edge 12 leading to the next cam step 13.

If, for some reason, it is desired to rotate the minute hand shaft in a counterclockwise sense (arrow 51), e.g., for the purpose of setting the minute hand of the clock, cam step 14 would be rotated in the direction of arrow 51 back to a position where the edge of step 14 would engage finger 29 which, in the absence of structure provided by the present invention, would block further counterclockwise rotation of cam 11 and minute hand shaft 10. If, under these conditions, an attempt was made to force further counterclockwise rotation of minute hand shaft 10, portions of the clock mechanism could be damaged. However, structure provided in accordance with the present invention permits continuing counterclockwise rotation.

More specifically, the flexible nature of leaf spring member 26 and the manner in which it is attached to lever flange 25 comprise means mounting finger 29 on the lever for movement between a first or operative position (FIG. 3) in which the finger is disposed to engage the periphery of cam 11 and a displaced second position (FIG. 4) in which finger 29 is incapable of engaging the periphery of the cam. Because flexible member 26 is composed of springable material, it normally biases finger 29 to its first or operative position (FIG. 3). Movement of finger 29 between its two positions is in a direction transverse to the direction of pivotal movement of lever 16.

As shown in FIGS. 3 and 4, edge 30 on finger 29 extends transversely to and angularly away from the edge of cam step 14. When cam 11 rotates in a counterclockwise sense (arrow 51), the edge of step 14 engages angular edge 30 on finger 29, and these two edges cooperate to flex member 26 and move finger 29 to its displaced second position (FIG. 4) in response to counterclockwise movement of the cam.

Flange 25 of lever 16 comprises stop means for limiting movement of finger 29, under the urging of the springable member 26, beyond the operative position illustrated in FIG. 3 wherein finger 29 extends transversely to the plane of cam 11 to intersect the plane of the cam. When finger 29 is in its second position (FIG. 4), it is in a non-intersecting disposition relative to the plane of the cam.

As previously noted, flexible leaf spring member 26 is fixed to lever flange 25, by rivet 27, at a location remote from finger 29, to permit member 26 to flex and accommodate the movement of finger 29 between its first and second positions illustrated in FIGS. 3 and 4.

When finger 29 is in its second position (FIG. 4) it rests against the planar surface 52 of cam 11. In such a situation, in the absence of restraining structure, lever 16 would be urged, by spring 23, to pivot further toward shaft 10, and this would be undesirable because it would place finger 29 closer to shaft 10 than the closest part of cam steps 13, 14. This, in turn, would cause finger 29 to remain on the planar surface 52 of cam 11 and prevent finger 29 from returning to its normal position for engaging the periphery of cam 11 when clockwise rotation of cam 11 resumes. Restraining structure, for preventing this from occurring, is illustrated in FIG. 5.

More specifically, lever 16 includes a projection 32. When lever 16 is pivoted sharply toward shaft 10 in response to finger 29 dropping off one of cam steps 13, 14, projection 32 engages the edge of a slot 33 in clock back plate 21, and this engagement limits pivotal movement of lever 16 to a position in which finger 29, carried by lever 16, is located further from the axis of cam 11 and of minute hand shaft 10 than that part of either cam step 13 or 14 closest to said axis.

As a result, when clockwise rotation of minute hand shaft 10 and cam 11 resumes, and the cam rotates to a position at which one of cam steps 13, 14 is in registry with finger 29, the finger will return from its second position (FIG. 4) to its first position (FIG. 3) and reengage periphery 12 of cam 11.

The embodiment of FIGS. 1–5 utilizes a flexible spring member 26 which may be damaged by rough handling or by undue pressure exerted against it through lever 16 during the manufacturing and assembling process of the clock embodying this structure. Such damage to member 26 or finger 29 thereon could cause the cam follower mechanism 15 to become inoperable or malfunction.

Figure 7:
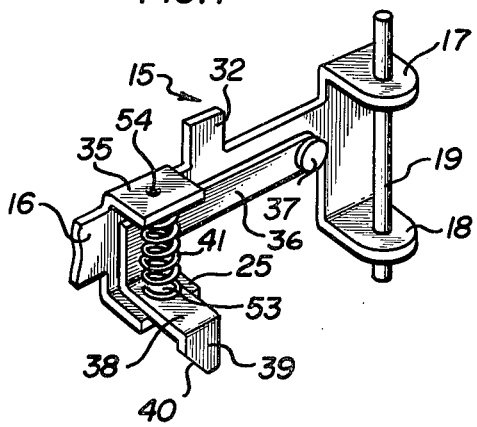
FIG. 7 is a fragmentary perspective illustrating a portion of the cam follower mechanism of the embodiment of FIG. 6.
Figure 6:
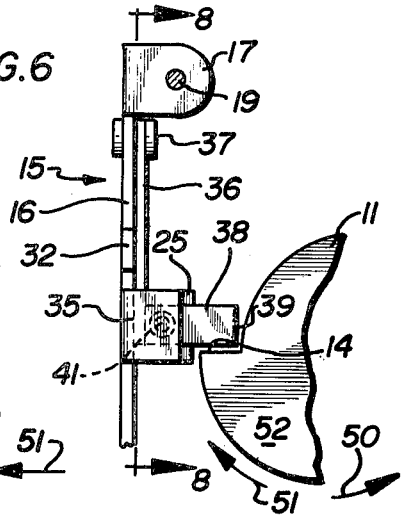
FIG. 6 is a rear view, similar to FIG. 1, showing another embodiment of structure in accordance with the present invention.
Figure 8:
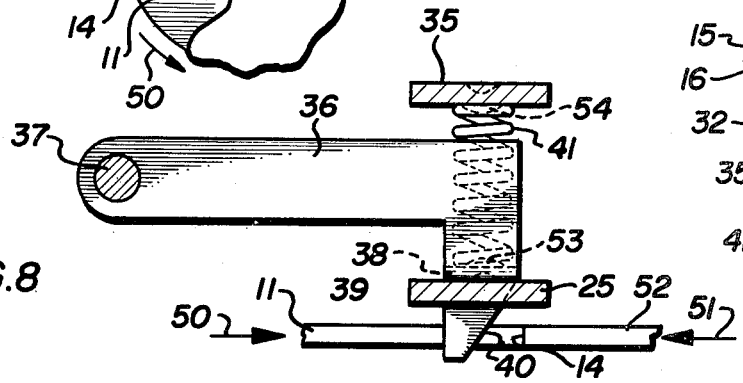
FIG. 8 is a sectional view taken along line 8—8 in FIG. 6.

The embodiment illustrated in FIGS. 6–8 avoids the damage to which the embodiment of FIGS. 1–5 is susceptible. In the embodiment of FIGS. 6–8, flexible leaf spring member 26 is replaced by a rigid member 36 heavy enough to resist flexing or becoming easily damaged. Rigid member 36 has one end attached to lever 16 by a shoulder rivet 37, and member 36 is mounted for pivotal movement, relative to lever 16, about the axis of shoulder rivet 37. Extending transversely from that end of member 36 remote from shoulder rivet 37 is a transverse portion 38 from which depends a finger 39 having an angular edge 40.

The pivotal attachment of member 36 to lever 16 at shoulder rivet 37 mounts finger 39 for pivotal movement between first and second positions corresponding to the first and second positions of finger 29 shown in FIGS. 3 and 4. While finger 29 was normally maintained in its first position by the springable material of which member 26 was composed, finger 39 is maintained in its first position by the urging of a coil spring 41 having one end portion engaging the transverse portion 38 of rigid pivotal member 36 at a detent 53 and another end portion engaging a second flange 35 on lever 16 at a detent 54. Flange 35 is parallel to first lever flange 25 and, like flange 25, extends transversely from lever 16 toward cam 11.

Finger 39 operates much the same as does finger 29. During rotation of cam 11 in a clockwise sense (arrow 50), the outer surface of finger 39, adjacent cam 11, engages the periphery 12 of the cam. During counterclockwise rotation of cam 11 (arrow 51), the edge of cam step 14 engages edge 40 on finger 39 and the two edges cooperate to move the finger from its first or operative position (FIG. 8) to its second or displaced position in which finger 39 is in a position similar to that of finger 29 in FIG. 4. In its second position, finger 39 abuts against planar surface 52 on cam 11. When cam 11 resumes its clockwise rotation and rotates to a position in which one of its steps 13, 14 is in registry with finger 39, spring 41 urges finger 39 to return to its first position for re-engagement with cam periphery 12. Flange 25 limits pivotal movement of finger 39, and member 36, beyond the first position thereof illustrated in FIG. 8.

The foregoing detailed description has been given for clearness of understanding only, and no unnecessary limitations should be understood therefrom, as modifications will be obvious to those skilled in the art.

I claim:

1. In a clock having a minute hand shaft capable of rotation in both clockwise and counterclockwise senses:

a cam having at least one cam step with an edge;

means mounting said cam for rotation in said clockwise and counterclockwise senses with said minute hand shaft;

cam follower means comprising a lever;

means mounting said lever for pivotal movement toward and away from said cam;

first biasing means normally urging said lever toward said cam;

finger means carried on said lever for engaging the periphery of said cam;

means mounting said finger means on said lever for movement between (a) an operative first position in which said finger means is disposed to engage the periphery of said cam and obstruct counterclockwise rotation of said cam and (b) a displaced second position in which the finger means is incapable of engaging the periphery of said cam or of obstructing said counterclockwise rotation;

second biasing means normally urging said finger means to its first position;

and means on said finger means and on the edge of said cam step cooperating to move said finger means to its second position in response to counterclockwise movement of said cam.

2. In a clock as recited in claim 1 wherein said cooperating means on the finger means comprises an edge on said finger means extending transversely to and angularly away from said edge on the cam step.

3. In a clock as recited in claim 2 wherein said finger-mounting means comprises stop means for limiting movement of said finger means, under the urging of said second biasing means, beyond said first position thereof.

4. In a clock as recited in claim 1 wherein:

said cam extends in a plane;

and said finger means extends transversely to the plane of said cam to intersect said plane of the cam when the finger means is in its first position;

said finger means being in a non-intersecting disposition, relative to the plane of said cam, when the finger means is in its second position.

5. In a clock as recited in claim 1 wherein:

said second biasing means comprises flexible leaf spring means connected to said finger means and means fixing said leaf spring means to said lever at a location remote from said finger means to permit the leaf spring means to flex and accommodate said movement of the finger means between its first and second positions.

6. In a clock as recited in claim 1 wherein:

said finger-mounting means comprises means mounting said finger means for pivotal movement, relative to said lever, between said first and second positions of the finger means.

7. In a clock as recited in claim 6 wherein:

said second biasing means comprises spring means having one portion engaging said finger means and another portion engaging said lever.

8. In a clock as recited in claim 1 and comprising:

means for limiting said pivotal movement of said lever and said finger means carried thereby, under the urging of said first biasing means, when the finger means is in its second position, to a position in which the finger means is located further from the axis of said cam than the part of said cam step closest to said axis.

9. In a clock as recited in claim 1 wherein said finger-mounting means comprises means mounting said finger means for movement in a direction transverse to the direction of pivotal movement of said lever.

* * * * *